US009424980B2

(12) United States Patent
Seko

(10) Patent No.: US 9,424,980 B2
(45) Date of Patent: Aug. 23, 2016

(54) ELECTRONIC COMPONENT AND METHOD OF PRODUCING SAME

(71) Applicant: MURATA MANUFACTURING CO., LTD., Kyoto-fu (JP)

(72) Inventor: Atsushi Seko, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/448,956

(22) Filed: Jul. 31, 2014

(65) Prior Publication Data

US 2014/0375412 A1 Dec. 25, 2014

Related U.S. Application Data

(63) Continuation of application No. 13/545,378, filed on Jul. 10, 2012, now Pat. No. 8,810,350.

(30) Foreign Application Priority Data

Jul. 11, 2011 (JP) ..... 2011-152589

(51) Int. Cl.

| | |
|---|---|
| ***H01F 27/29*** | (2006.01) |
| ***H01F 5/00*** | (2006.01) |
| ***H01F 27/28*** | (2006.01) |
| ***H01F 17/00*** | (2006.01) |
| ***H01F 41/04*** | (2006.01) |

(52) U.S. Cl.

CPC ..... *H01F 27/2804* (2013.01); *H01F 17/0013* (2013.01); *H01F 27/292* (2013.01); *H01F 41/043* (2013.01); *H01F 2027/2809* (2013.01)

(58) Field of Classification Search

CPC ..... H01F 27/2804; H01F 27/292; H01F 2027/2809; H01F 41/043; H01F 17/0013

USPC ..... 336/200, 234, 192

See application file for complete search history.

(56) References Cited

U.S. PATENT DOCUMENTS

| | | | |
|---|---|---|---|
| 8,201,318 | B2 | 6/2012 | Yamano |
| 2001/0026017 | A1 | 10/2001 | Seto |
| 2002/0177360 | A1 | 11/2002 | Nakayama |

(Continued)

FOREIGN PATENT DOCUMENTS

| | | | |
|---|---|---|---|
| CN | 1172413 | A | 2/1998 |
| CN | 100348661 | C | 11/2007 |

(Continued)

OTHER PUBLICATIONS

An Office Action "Notice of Preliminary Rejection" issued by the Korean Intellectual Property Office on Aug. 12, 2013, Korean Patent Application No. 10-2012-74914.

(Continued)

*Primary Examiner* — Mangtin Lian
(74) *Attorney, Agent, or Firm* — Studebaker & Brackett PC

(57) ABSTRACT

A laminate in which plural insulator layers are stacked includes an external electrode that is exposed to the exterior of the laminate and includes a plurality of conductive layers stacked in a staking direction and passing through some of the plural insulator layers in the stacking direction. At least one side of the external electrode facing in the stacking direction is overlaid with rest of the plural insulator layers. At least one side surface of the external electrode facing in the stacking direction is uneven with another portion of the side surface.

5 Claims, 12 Drawing Sheets

(56) References Cited

U.S. PATENT DOCUMENTS

| | | | | |
|---|---|---|---|---|
| 2003/0030994 | A1* | 2/2003 | Takaya et al. | 361/728 |
| 2008/0257488 | A1* | 10/2008 | Yamano | 156/272.4 |
| 2009/0153282 | A1* | 6/2009 | Taoka | H01F 17/0013 336/200 |
| 2011/0012701 | A1 | 1/2011 | Lu et al. | |
| 2011/0291790 | A1 | 12/2011 | Okumura et al. | |

FOREIGN PATENT DOCUMENTS

| | | | |
|---|---|---|---|
| JP | 11-214235 | A | 8/1999 |
| JP | 2000-348939 | A | 12/2000 |
| JP | 2002-353071 | A | 12/2002 |
| JP | 2006-114552 | A | 4/2006 |
| JP | 2006-135139 | A | 5/2006 |
| JP | 2007-134555 | A | 5/2007 |
| JP | 2007-142107 | A | 6/2007 |
| JP | 2010-165975 | A | 7/2010 |
| JP | 2010-205750 | A | 9/2010 |
| WO | 2007/080680 | A1 | 7/2007 |

OTHER PUBLICATIONS

An Office Action "Notice of Allowance" issued by the Korean Intellectual Property Office on Jan. 2, 2014, Korean Patent Application No. 10-2012-0074914.

An Office Action issued by the State Intellectual Property Office of the People's Republic of China on Mar. 19, 2014, Chinese Patent Application No. 201210237676.3.

An Office Action; "Notice of Reasons for Rejection," issued by the Japanese Patent Office on Apr. 5, 2016, which corresponds to Japanese Patent Application No. 2012-129405 and is related to U.S. Appl. No. 14/448,956; with English language translation.

* cited by examiner

ELECTRONIC COMPONENT AND METHOD OF PRODUCING SAME

CROSS REFERENCE TO RELATED APPLICATIONS

The present application claims priority from Japanese Patent Application No. 2011-152589 filed on Jul. 11, 2011, the entire contents of which are hereby incorporated by reference into this application.

TECHNICAL FIELD

The technical field relates to an electronic component and a method of producing the same, and in particular, to an electronic component that includes a laminate and a method of producing the same.

BACKGROUND

An example of a conventional electronic component is a stacked inductor described in Japanese Unexamined Patent Application Publication No. 2010-165975. FIG. 9 is an exploded perspective view of a stacked inductor 500 described in this patent literature.

As illustrated in FIG. 9, the stacked inductor 500 includes a laminate 502, external electrodes 508 and 510, and a coil L. The laminate 502 is one in which insulating layers 504*a* to 504*d* are stacked. The coil L is incorporated in the laminate 502 and includes coil conductive patterns 506*a* to 506*c* and via hole conductors V501 and V502. Each of the coil conductive patterns 506*a* to 506*c* has a substantially ring shape which is formed by cutting a part of a ring shape off. The coil conductive patterns 506*a* to 506*c* are disposed on the insulating layers 504*b* to 504*d*, respectively. The via hole conductor V501 connects the coil conductive patterns 506*a* and 506*b*. The via hole conductor V502 connects the coil conductive patterns 506*b* and 506*c*. Thus, the coil L has a substantially helical shape.

The external electrode 508 includes external electrode patterns 508*a* to 508*c*. Each of the external electrode patterns 508*a* to 508*c* has a substantially L shape. The external electrode patterns 508*a* to 508*c* are disposed in corners of the insulating layers 504*b* to 504*d*, respectively. The external electrode 510 includes external electrode patterns 510*a* to 510*c*. Each of the external electrode patterns 510*a* to 510*c* has a substantially L shape. The external electrode patterns 510*a* to 510*c* are disposed in corners of the insulating layers 504*b* to 504*d*, respectively. The top and bottom of the external electrodes 508 and 510 in the stacking direction thereof are overlaid with the insulating layers 504*a* and 504*d*, respectively.

SUMMARY

The present disclosure provides an electronic component capable of suppressing the occurrence of breakage of a laminate and a method of producing the electronic component.

According to an aspect of the present disclosure, an electronic component includes a laminate in which plural insulator layers are stacked and an external electrode exposed to an exterior of the laminate includes plural conductive layers stacked in a staking direction. Each of the conductive layers pass through a first part of the plural insulator layers in a stacking direction. At least one side of the external electrode in the stacking direction is overlaid with a second part of the plural insulator layers. At least one side surface of the external electrode facing in the stacking direction includes a portion that is uneven with another portion of the side surface.

According to another aspect of the present invention, a method of producing an electronic component includes a first step of forming an outer insulator layer, a second step of forming, on the outer insulator layer, an inner insulator layer in which an opening is formed, a third step of forming a conductive layer on the inner insulator layer, the conductive layer having an area larger than the opening and overlapping the opening, and a fourth step of cutting a mother laminate including the outer insulator layer and the inner insulator layer into a plurality of laminates. In the fourth step an external electrode including the conductive layer is exposed from the laminate in a first cut surface formed by the cutting.

Other features, elements, characteristics, and advantages of the present disclosure will become more apparent from the following detailed description with reference to the attached drawings.

DETAILED DESCRIPTION

The inventor realized that in the stacked inductor 500 described in Japanese Unexamined Patent Application Publication No. 2010-165975, the laminate 502 may be damaged. More specifically, the process of producing the stacked inductor 500 contains a dividing step of dividing a mother laminate into individual laminates 502 and a firing step of firing the laminates 502. In the dividing step and the firing step, a stress is applied to each of the laminates 502. Because the material of the laminate 502 differs from the material of the external electrodes 508 and 510, when a stress is applied to the laminate 502, an internal stress remains between the laminate 502 and the external electrodes 508 and 510. If the laminate 502 is subjected to barrel polishing or plating in the state where the internal stress remains, the impact of the barrel polishing or plating may cause breakage such as a crack or the like in a portion in each of the insulating layers 504*a* and 504*d*, the portion being in contact with the external electrodes 508 and 510.

An electronic component according to exemplary embodiments and a method of producing the same that can address the above-described breakage issues will now be described.

Figure 1:
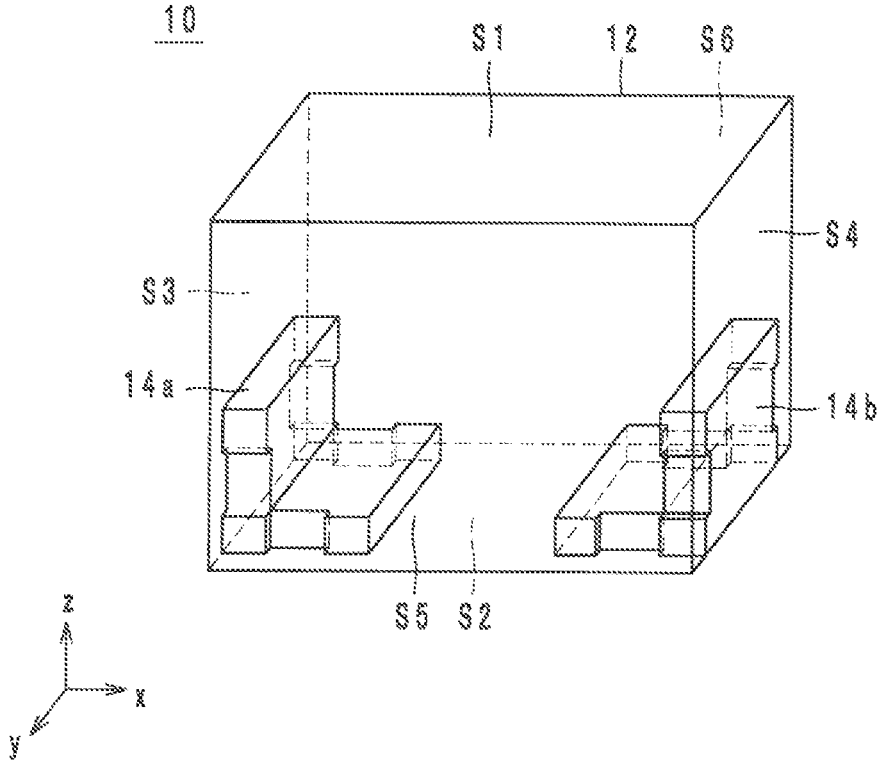
FIG. 1 is a perspective view of an electronic component according to a first exemplary embodiment.
Figure 2:
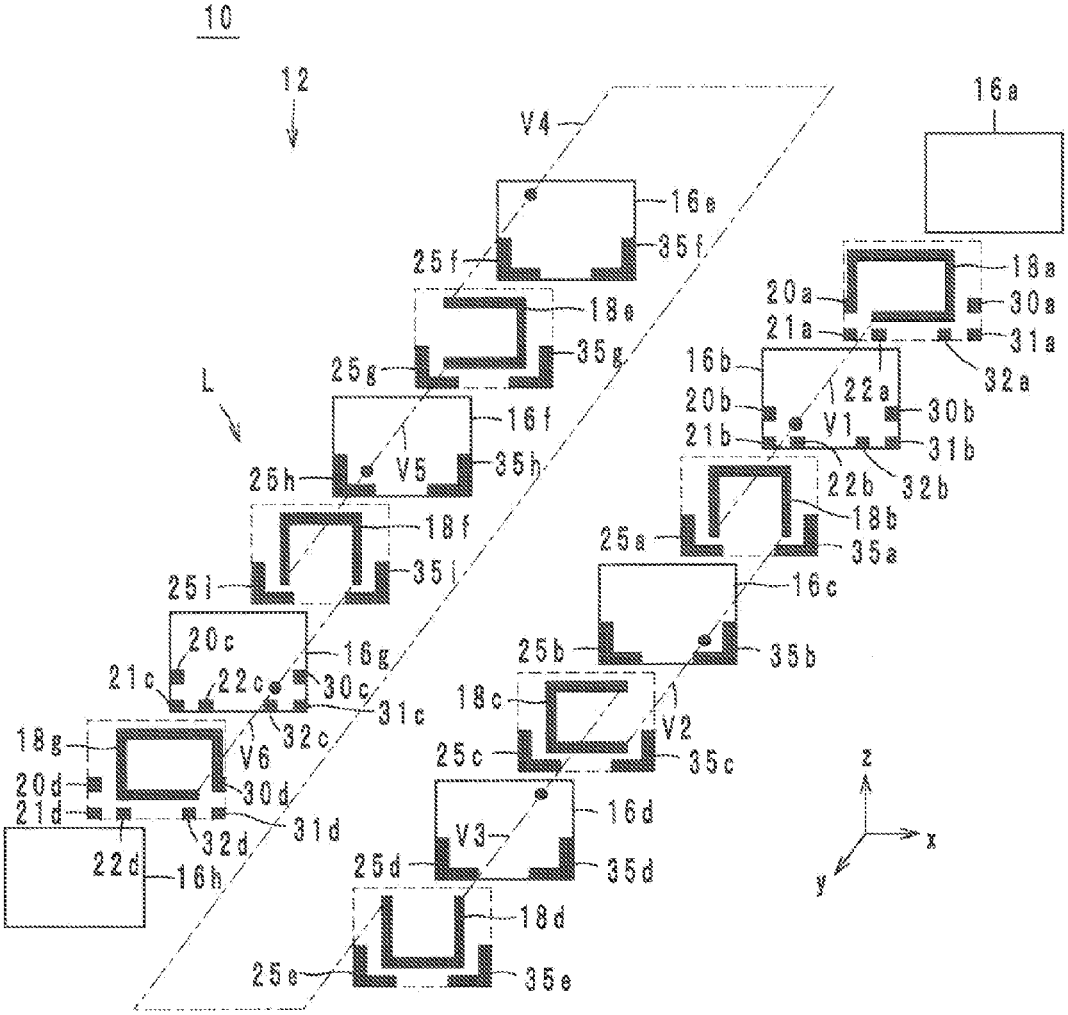
FIG. 2 is an exploded perspective view of the electronic component illustrated in FIG. 1.
Figure 3A:
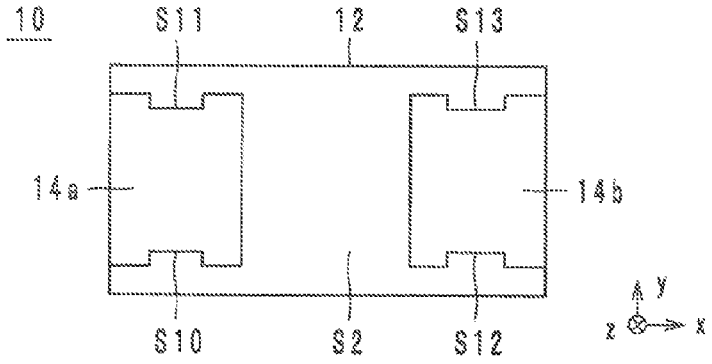
FIG. 3A illustrates the electronic component in plan view from a negative z-axis direction.
Figure 3B:
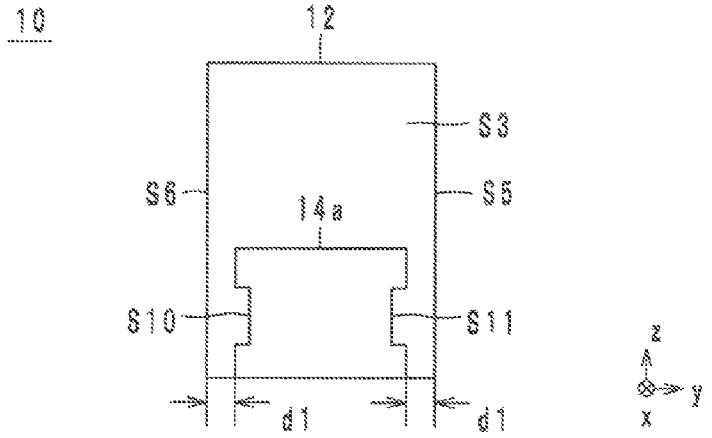
FIG. 3B illustrates the electronic component in plan view from a negative x-axis direction.
Figure 3C:
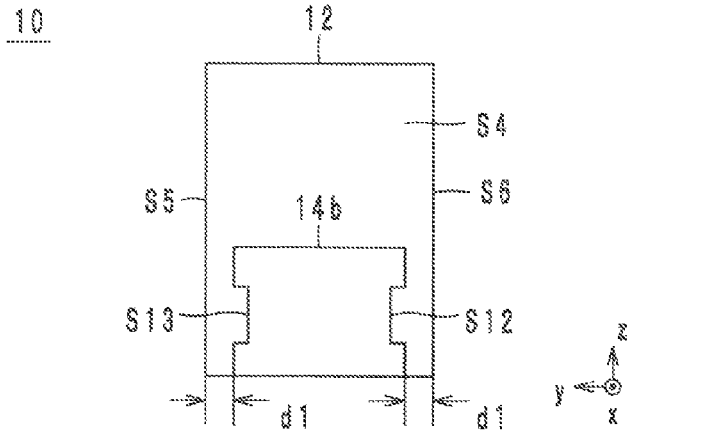
FIG. 3C illustrates the electronic component in plan view from a positive x-axis direction.

A configuration of an electronic component according to an exemplary embodiment is described below with reference to the drawings. FIG. 1 is a perspective view of an electronic component 10 according to a first exemplary embodiment. FIG. 2 is an exploded perspective view of the electronic component 10 illustrated in FIG. 1. In the following description, the stacking direction of the electronic component 10 is defined as the y-axis direction. In plan view from the y-axis direction, the direction in which the long sides of the electronic component 10 extend is defined as the x-axis direction and the direction in which the short sides of the electronic component 10 extend is defined as the z-axis direction. FIG. 3A illustrates the electronic component 10 in plan view from the negative z-axis direction, FIG. 3B illustrates the electronic component 10 in plan view from the negative x-axis direction, and FIG. 3C illustrates the electronic component 10 in plan view from the positive x-axis direction.

As illustrated in FIGS. 1 and 2, the electronic component 10 includes a laminate 12, external electrodes 14 (14*a*, 14*b*), and a coil L (not illustrated in FIG. 1).

As illustrated in FIG. 2, the laminate 12 is one in which a plurality of insulator layers 16 (16*a* to 16*h*) are stacked in this order from negative to positive in the y-axis direction. The laminate 12 has a substantially rectangular parallelepiped shape. The laminate 12 includes an upper surface S1, a lower surface S2, end surfaces S3 and S4, and side surfaces S5 and S6. The upper surface S1 is the surface of the laminate 12 in the positive z-axis direction. The lower surface S2 is the surface of the laminate 12 in the negative z-axis direction and a mounting surface that faces a circuit substrate when the electronic component 10 is mounted on the circuit substrate. The upper surface S1 is a series of the long sides (outer edges) of the insulator layers 16 facing in the positive z-axis direction, and the lower surface S2 is a series of the long sides (outer edges) of the insulator layers 16 facing in the negative z-axis direction. The end surface S3 is the surface of the laminate 12 facing in the negative x-axis direction, and the end surface S4 is the surface of the laminate 12 facing in the positive x-axis direction. The end surface S3 is a series of the short sides (outer edges) of the insulator layers 16 facing in the negative x-axis direction, and the end surface S4 is a series of the short sides (outer edges) of the insulator layers 16 facing in the positive x-axis direction. The end surfaces S3 and S4 are adjacent surfaces to the lower surface S2. The side surface S5 is the surface of the laminate 12 facing in the positive y-axis direction, and the side surface S6 is the surface of the laminate 12 facing in the negative y-axis direction.

As illustrated in FIG. 2, each of the insulator layers 16 can have a substantially rectangular shape and can be made of an insulating material whose main component is a borosilicate glass, for example. In the following description, the surface of the insulator layer 16 facing in the positive y-axis direction is referred to as a front surface, and the surface of the insulator layer 16 facing in the negative y-axis direction is referred to as a back surface.

The coil L includes coil conductive layers 18 (18*a* to 18*g*) and via hole conductors V1 to V6. The coil L has a substantially helical shape turning clockwise in plan view from the positive y-axis direction and winding from negative to positive in the y-axis direction. The coil conductive layers 18*a* to 18*g* are disposed on the insulator layers 16*a* to 16*g*, respectively. Each of the coil conductive layers 18*a* to 18*g* has a substantially rectangular ring shape which is formed by cutting off (i.e., excluding) a part of a rectangular ring shape. The number of turns of each of the coil conductive layers 18*a* to 18*g* is about 3/4. Each of the coil conductive layers 18 can be made of a conductive material whose main component is silver, for example. In the following description, the upstream end in the clockwise direction of each coil conductive layer 18 is referred to as an upstream end, and the downstream end in the clockwise direction of each coil conductive layer 18 is referred to as a downstream end.

The via hole conductors V1 to V6 pass through the insulator layers 16*b* to 16*g* in the y-axis direction, respectively. The via hole conductors V1 to V6 can be made of a conductive material whose main component is silver, for example. The via hole conductor V1 connects the downstream end of the coil conductive layer 18*a* and the upstream end of the coil conductive layer 18*b*. The via hole conductor V2 connects the downstream end of the coil conductive layer 18*b* and the upstream end of the coil conductive layer 18*c*. The via hole conductor V3 connects the downstream end of the coil conductive layer 18*c* and the upstream end of the coil conductive layer 18*d*. The via hole conductor V4 connects the downstream end of the coil conductive layer 18*d* and the upstream end of the coil conductive layer 18*e*. The via hole conductor V5 connects the downstream end of the coil conductive layer 18*e* and the upstream end of the coil conductive layer 18*f*. The via hole conductor V6 connects the downstream end of the coil conductive layer 18*f* and the upstream end of the coil conductive layer 18*g*.

As illustrated in FIG. 1, the external electrode 14*a* is embedded in the laminate 12 and is exposed to the exterior of the laminate 12 so as to extend over the border between the end surface S3 and the lower surface S2. That is, in plan view from the y-axis direction, the external electrode 14*a* is substantially L-shaped. As illustrated in FIG. 2, the external electrode 14*a* is one in which external electrode conductive layers 20 (20*a* to 20*d*), 21 (21*a* to 21*d*), (22*a* to 22*d*), and 25 (25*a* to 25*i*) are stacked. The external electrode conductive layers 20 (20*a* to 20*d*), 21 (21*a* to 21*d*), 22 (22*a* to 22*d*), and 25 (25*a* to 25*i*) are stacked, thus passing through the insulator layers 16*b* to 16*g* in the y-axis direction and being electrically coupled together, as illustrated in FIG. 2.

The external electrode conductive layers 25*b*, 25*d*, 25*f*, and 25*h* pass through the insulator layers 16*c*, 16*d*, 16*e*, and 16*f*, respectively, in the y-axis direction and are substantially L-shaped. In plan view from the y-axis direction, the external electrode conductive layers 25*b*, 25*d*, 25*f*, and 25*h* are in contact with the short side of each of the insulator layers 16*a* and 16*h* in the negative x-axis direction and the long side thereof in the negative z-axis direction.

The external electrode conductive layers 25*a* to 25*i* coincide with each other in plan view from the y-axis direction. The external electrode conductive layer 25*b* is in contact with the external electrode conductive layers 25*a* and 25*c*. The external electrode conductive layer 25*d* is in contact with the external electrode conductive layers 25*c* and 25*e*. The external electrode conductive layer 25*f* is in contact with the external electrode conductive layers 25*e* and 25*g*. The external electrode conductive layer 25*h* is in contact with the external electrode conductive layers 25*g* and 25*i*.

The external electrode conductive layers 20*a*, 21*a*, and 22*a* are disposed on the front surface of the insulator layer 16*a* and are substantially rectangular. The external electrode conductive layers 20*a*, 21*a*, and 22*a* have a shape different from the shape of each of the external electrode conductive layers 25*a* to 25*i* in plan view from the y-axis direction and overlap the external electrode conductive layers 25*a* to 25*i* in plan view from the y-axis direction. More specifically, the external electrode conductive layer 21*a* is disposed in the corner of the insulator layer 16*a* in the negative x-axis direction and in the negative z-axis direction. The external electrode conductive layer 20*a* is disposed on the positive z-axis direction side with respect to the external electrode conductive layer 21*a* and is in contact with the short side of the insulator layer 16*a* in the negative x-axis direction. The external electrode conductive layer 20*a* is connected to the upstream end of the coil conductive layer 18*a*. The external electrode conductive layer 22*a* is disposed on the positive x-axis direction side with respect to the external electrode conductive layer 21*a* and is in contact with the long side of the insulator layer 16*a* in the negative z-axis direction.

The external electrode conductive layers 20*b*, 21*b*, and 22*b* pass through the insulator layer 16*b* in the y-axis direction and coincide with the external electrode conductive layers 20*a*, 21*a*, and 22*a*, respectively, in plan view from the y-axis direction. The external electrode conductive layers 20*b*, 21*b*, and 22*b* are in contact with the external electrode conductive layers 20*a*, 21*a*, and 22*a*, respectively.

The external electrode conductive layers 20*c*, 21*c*, and 22*c* pass through the insulator layer 16*g* in the y-axis direction and coincide with the external electrode conductive layers 20*a*, 21*a*, and 22*a*, respectively, in plan view from the y-axis direction.

The external electrode conductive layers 20*d*, 21*d*, and 22*d* coincide with the external electrode conductive layers 20*c*, 21*c*, and 22*c*, respectively, in plan view from the y-axis direction. The external electrode conductive layers 20*d*, 21*d*, and 22*d* are in contact with the external electrode conductive layers 20*c*, 21*c*, and 22*c*, respectively.

In the external electrode 14*a*, in which the external electrode conductive layers 20, 21, 22, and 25 are stacked in the above-described way, a side surface S10 of the external electrode 14*a* located at the end in the negative y-axis direction and a side surface S11 of the external electrode 14*a* located at the end in the positive y-axis direction are uneven, as illustrated in FIGS. 3A and 3B.

More specifically, the side surface S10 is defined by the external electrode conductive layers 20*a*, 20*b*, 21*a*, 21*b*, 22*a*, 22*b*, and 25*a*. The external electrode conductive layers 20*a*, 20*b*, 21*a*, 21*b*, 22*a*, and 22*b* protrude in the negative y-axis direction farther than the external electrode conductive layer 25*a*. Thus, the side surface S10 has a shape in which in plan view from the negative z-axis direction both ends thereof in the x-axis direction protrude in the negative y-axis direction and a substantially central portion thereof in the x-axis direction is depressed in the positive y-axis direction. The side surface S10 also has a shape in which in plan view from the negative x-axis direction both ends thereof in the z-axis direction protrude in the negative y-axis direction and a substantially central portion thereof in the z-axis direction is depressed in the positive y-axis direction.

The side surface S11 is defined by the external electrode conductive layers 20*c*, 20*d*, 21*c*, 21*d*, 22*c*, 22*d*, and 25*i*. The external electrode conductive layers 20*c*, 20*d*, 21*c*, 21*d*, 22*c*, and 22*d* protrude in the positive y-axis direction farther than the external electrode conductive layer 25*i*. The side surface S11 has a shape in which in plan view from the negative z-axis direction both ends thereof in the x-axis direction protrude in the positive y-axis direction and a substantially central portion thereof in the x-axis direction is depressed in the negative y-axis direction. The side surface S11 also has a shape in which in plan view from the negative x-axis direction both ends thereof in the z-axis direction protrude in the positive y-axis direction and a substantially central portion thereof in the z-axis direction is depressed in the negative y-axis direction.

As illustrated in FIG. 1, the external electrode 14*b* is embedded in the laminate 12 and is exposed to the exterior of the laminate 12 so as to extend over the border between the end surface S4 and the lower surface S2. That is, in plan view from the y-axis direction, the external electrode 14*b* is substantially L-shaped. As illustrated in FIG. 2, the external electrode 14*b* is one in which external electrode conductive layers 30 (30*a* to 30*d*), 31 (31*a* to 31*d*), (32*a* to 32*d*), and 35 (35*a* to 35*i*) are stacked. The external electrode conductive layers 30 (30*a* to 30*d*), 31 (31*a* to 31*d*), 32 (32*a* to 32*d*), and 35 (35*a* to 35*i*) are stacked, thus passing through part of the insulator layers 16 (the insulator layers 16*b* to 16*g*) in the y-axis direction and being electrically coupled together, as illustrated in FIG. 2.

The external electrode conductive layers 35*b*, 35*d*, 35*f*, and 35*h* pass through the insulator layers 16*c*, 16*d*, 16*e*, and 16*f*, respectively, in the y-axis direction and are substantially L-shaped. In plan view from the y-axis direction, the external electrode conductive layers 35*b*, 35*d*, 35*f*, and 35*h* are in contact with the short side of each of the insulator layers 16*a* and 16*h* (rest of the insulator layers 16) in the positive x-axis direction and the long side thereof in the negative z-axis direction.

The external electrode conductive layers 35*a* to 35*i* coincide with each other in plan view from the y-axis direction. The external electrode conductive layer 35*b* is in contact with the external electrode conductive layers 35*a* and 35*c*. The external electrode conductive layer 35*d* is in contact with the external electrode conductive layers 35*c* and 35*e*. The external electrode conductive layer 35*f* is in contact with the external electrode conductive layers 35*e* and 35*g*. The external electrode conductive layer 35*h* is in contact with the external electrode conductive layers 35*g* and 35*i*.

The external electrode conductive layers 30*a*, 31*a*, and 32*a* are disposed on the front surface of the insulator layer 16*a* and are substantially rectangular. The external electrode conductive layers 30*a*, 31*a*, and 32*a* have a shape different from the shape of each of the external electrode conductive layers 35*a* to 35*i* in plan view from the y-axis direction and overlap the external electrode conductive layers 35*a* to 35*i* in plan view from the y-axis direction. More specifically, the external electrode conductive layer 31*a* is disposed in the corner of the insulator layer 16*a* in the positive x-axis direction and in the negative z-axis direction. The external electrode conductive layer 30*a* is disposed on the positive z-axis direction side with respect to the external electrode conductive layer 31*a* and is in contact with the short side of the insulator layer 16*a* in the positive x-axis direction. The external electrode conductive layer 32*a* is disposed on the negative x-axis direction side with respect to the external electrode conductive layer 31*a* and is in contact with the long side of the insulator layer 16*a* in the negative z-axis direction.

The external electrode conductive layers 30*b*, 31*b*, and 32*b* pass through the insulator layer 16*b* in the y-axis direction and coincide with the external electrode conductive layers 30*a*, 31*a*, and 32*a*, respectively, in plan view from the y-axis direction. The external electrode conductive layers 30*b*, 31*b*, and 32*b* are in contact with the external electrode conductive layers 30*a*, 31*a*, and 32*a*, respectively.

The external electrode conductive layers 30*c*, 31*c*, and 32*c* pass through the insulator layer 16*g* in the y-axis direction and coincide with the external electrode conductive layers 30*a*, 31*a*, and 32*a*, respectively, in plan view from the y-axis direction.

The external electrode conductive layers 30*d*, 31*d*, and 32*d* coincide with the external electrode conductive layers 30*c*, 31*c*, and 32*c*, respectively, in plan view from the y-axis direction. The external electrode conductive layers 30*d*, 31*d*, and 32*d* are in contact with the external electrode conductive layers 30*c*, 31*c*, and 32*c*, respectively. The external electrode conductive layer 30*d* is connected to the downstream end of the coil conductive layer 18*g*.

The external electrode conductive layers 30, 31, 32, and 35 are stacked in the above-described way, whereby a side surface S12 of the external electrode 14*b* located at the end in the negative y-axis direction and a side surface S13 of the external electrode 14*b* located at the end in the positive y-axis direction are uneven, as illustrated in FIGS. 3A and 3C.

More specifically, the side surface S12 is defined by the external electrode conductive layers 30*a*, 30*b*, 31*a*, 31*b*, 32*a*, 32*b*, and 35*a*. The external electrode conductive layers 30*a*, 30*b*, 31*a*, 31*b*, 32*a*, and 32*b* protrude in the negative y-axis direction farther than the external electrode conductive layer 35*a*. The side surface S12 has a shape in which in plan view from the negative z-axis direction both ends thereof in the x-axis direction protrude in the negative y-axis direction and a substantially central portion thereof in the x-axis direction is depressed in the positive y-axis direction. The side surface S12 also has a shape in which in plan view from the positive x-axis direction both ends thereof in the z-axis direction protrude in the negative y-axis direction and a substantially central portion thereof in the z-axis direction is depressed in the positive y-axis direction.

The side surface S13 is defined by the external electrode conductive layers 30*c*, 30*d*, 31*c*, 31*d*, 32*c*, 32*d*, and 35*i*. The external electrode conductive layers 30*c*, 30*d*, 31*c*, 31*d*, 32*c*, and 32*d* protrude in the positive y-axis direction farther than the external electrode conductive layer 35*i*. The side surface S13 has a shape in which in plan view from the negative z-axis direction both ends thereof in the x-axis direction protrude in the positive y-axis direction and a substantially central portion thereof in the x-axis direction is depressed in the negative y-axis direction. The side surface S13 also has a shape in which in plan view from the positive x-axis direction both ends thereof in the z-axis direction protrude in the positive y-axis direction and a substantially central portion thereof in the z-axis direction is depressed in the negative y-axis direction.

The portion of each of the external electrodes 14*a* and 14*b* exposed from the laminate 12 to the outside is subjected to nickel plating and tin plating and to prevent corrosion.

Each of both sides of the each of the external electrodes 14*a* and 14*b* in the y-axis direction is overlaid with the insulator layer 16*a* or 16*h*. Thus, the external electrodes 14*a* and 14*b* are not exposed in the side surfaces S5 and S6.

A method of producing the electronic component 10 according to the first exemplary embodiment will now be described with reference to the drawings. FIGS. 4A to 7C are plan views of the electronic component 10 in production.

Figure 4A:
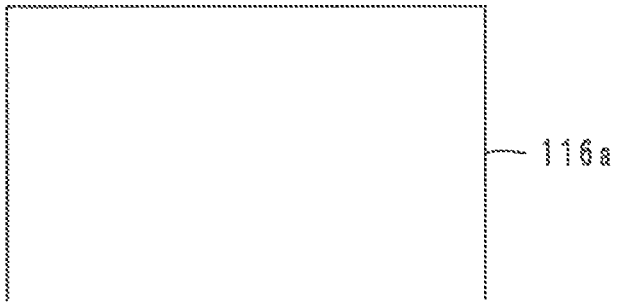
FIGS. 4A to 4D are plan views of the electronic component in production.

First, as illustrated in FIG. 4A, insulating paste whose main component is a borosilicate glass is applied by screen printing to form an insulating paste layer 116*a*. The insulating paste layer 116*a* is a paste layer that is to become the insulator layer 16*a*, which is an outer insulator layer located outside the coil L.

Figure 4B:
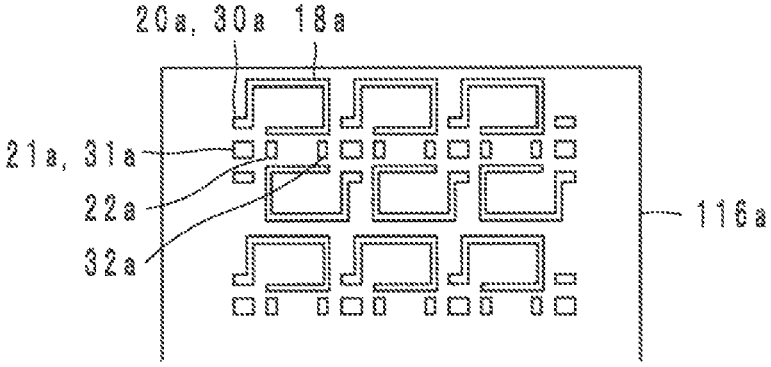

Next, as illustrated in FIG. 4B, the coil conductive layers 18*a* and the external electrode conductive layers 20*a*, 21*a*, 22*a*, 30*a*, 31*a*, and 32*a* are formed by a photolithography step. Specifically, photosensitive conductive paste whose metal main component is silver is applied by screen printing to form a photosensitive conductive paste layer on the insulating paste layer 116*a*. In addition, the photosensitive conductive paste layer is irradiated with ultraviolet rays or other rays through a photomask and developed using an alkaline solution or other solution.

Figure 4C:
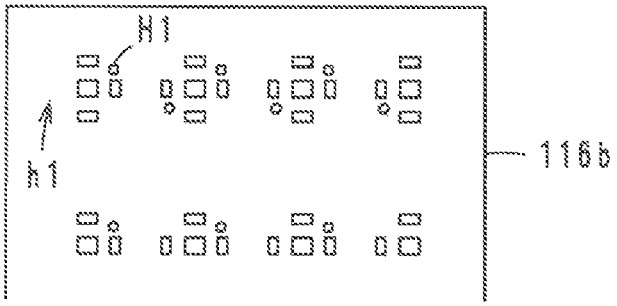

Then, as illustrated in FIG. 4C, an insulating paste layer 116*b* having a plurality of opening group h1 and via holes H1 is formed by a photolithography step. Specifically, insulating paste is applied by screen printing to from an insulating paste layer on the insulating paste layer 116*a*. In addition, the photosensitive conductive paste layer is irradiated with ultraviolet rays or other rays through a photomask and developed using an alkaline solution or other solution. The insulating paste layer 116*b* is a paste layer that is to become the insulator layer 16*b*, which is an inner insulator layer on which the coil L is disposed. Each of the opening group h1 has substantially the same shape as that of set of the external electrode conductive layers 20*a*, 21*a*, 22*a*, 30*a*, 31*a*, and 32*a* and overlaps the external electrode conductive layers 20*a*, 21*a*, 22*a*, 30*a*, 31*a*, and 32*a*.

Figure 4D:
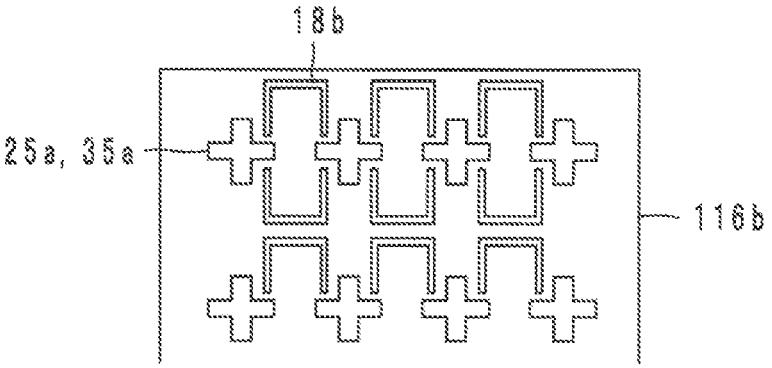

Then, as illustrated in FIG. 4D, the coil conductive layers 18*b*, the external electrode conductive layers 20*b*, 21*b*, 22*b*, 30*b*, 31*b*, 32*b*, 25*a*, and 35*a*, and the via hole conductors V1 are formed by a photolithography step. Specifically, photosensitive conductive paste whose metal main component is silver is applied by screen printing to form a photosensitive conductive paste layer on the insulating paste layer 116*b*. In addition, the photosensitive conductive paste layer is irradiated with ultraviolet rays or other rays through a photomask and developed using an alkaline solution or other solution. In the step, the conductive layers are formed on the insulating paste layer 116*b* so as to have an area larger than corresponding opening group h1 and overlap the corresponding opening group h1. In this way, the external electrode conductive layers 20*b*, 21*b*, 22*b*, 30*b*, 31*b*, and 32*b* are formed in the opening group h1. The via hole conductors V1 are formed in the via holes H1. In FIG. 4D, the external electrode conductive layers 20*b*, 21*b*, 22*b*, 30*b*, 31*b*, and 32*b* and the via hole conductors V1 are not illustrated because they are hidden by the coil conductive layer 18*b* and the external electrode conductive layers 25*a* and 35*a*.

Figure 5A:
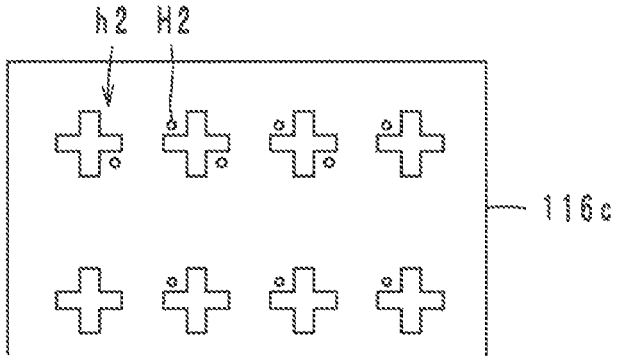
FIGS. 5A to 5D are plan views of the electronic component in production.

Then, as illustrated in FIG. 5A, an insulating paste layer 116*c* having openings h2 and via holes H2 is formed by a photolithography step. Specifically, insulating paste is applied by screen printing to form an insulating paste layer on the insulating paste layer 116*b*. In addition, the photosensitive conductive paste layer is irradiated with ultraviolet rays or other rays through a photomask and developed using an alkaline solution or other solution. The insulating paste layer 116*c* is a paste layer that is to become the insulator layer 16*c*, which is an internal insulator layer. Each of the openings h2 has a cross shape in which the two external electrode conductive layers 25*b* and the two external electrode conductive layers 35*b* are combined.

Figure 5B:
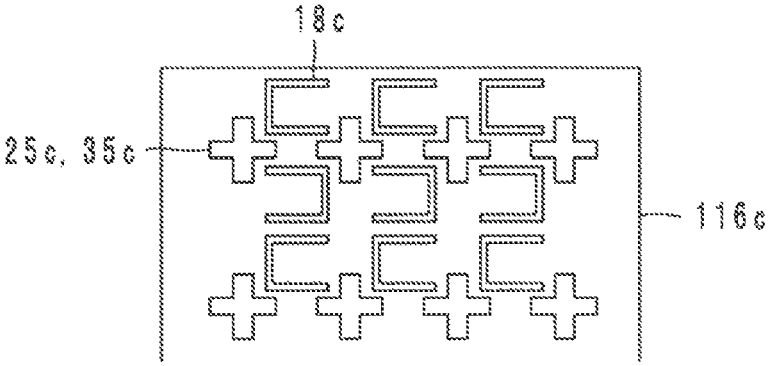

Then, as illustrated in FIG. 5B, the coil conductive layers 18*c*, the external electrode conductive layers 25*b*, 25*c*, 35*b*, and 35*c*, and the via hole conductors V2 are formed by a photolithography step. Specifically, photosensitive conductive paste whose main metal component is silver is applied by screen printing to form a photosensitive conductive paste layer on the insulating paste layer 116*c*. In addition, the photosensitive conductive paste layer is irradiated with ultraviolet rays or other rays through a photomask and developed using an alkaline solution or other solution. In this way, the external electrode conductive layers 25*b* and 35*b* are formed in the openings h2. The via hole conductors V2 are formed in the via holes H2. In FIG. 5B, the external electrode conductive layers 25*b* and 35*b* and the via hole conductors V2 are not illustrated because they are hidden by the coil conductive layers 18*c* and the external electrode conductive layers 25*c* and 35*c*.

Figure 5C:
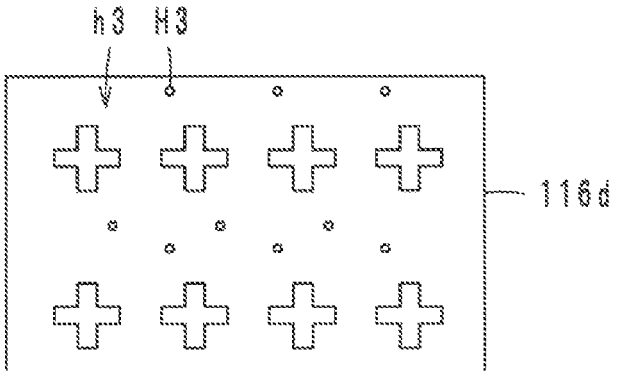

Then, as illustrated in FIG. 5C, an insulating paste layer 116*d* having openings h3 and via holes H3 is formed by a photolithography step. Specifically, insulating paste is applied by screen printing to from an insulating paste layer on the insulating paste layer 116*c*. In addition, the photosensitive conductive paste layer is irradiated with ultraviolet rays or other rays through a photomask and developed using an alkaline solution or other solution. The insulating paste layer 116*d* is a paste layer that is to become the insulator layer 16*d*, which is an inner insulator layer. Each of the openings h3 has substantially the same shape as that of each of the openings h2.

Figure 5D:
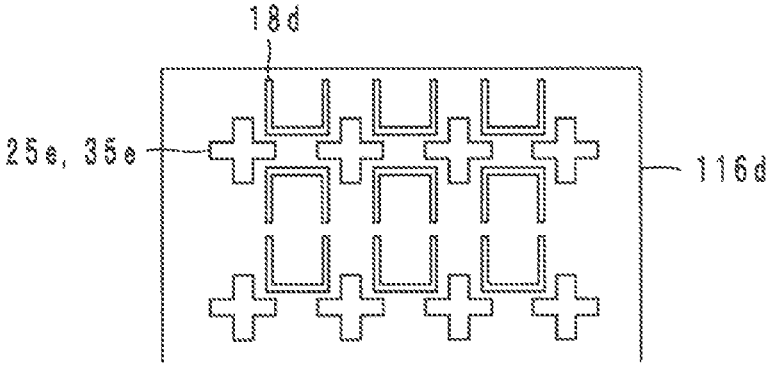

Then, as illustrated in FIG. 5D, the coil conductive layers 18*d*, the external electrode conductive layers 25*d*, 25*e*, 35*d*, and 35*e*, and the via hole conductors V3 are formed by a photolithography step. Specifically, photosensitive conductive paste whose metal main component is silver is applied by screen printing to form a photosensitive conductive paste layer on the insulating paste layer 116*d*. In addition, the photosensitive conductive paste layer is irradiated with ultraviolet rays or other rays through a photomask and developed using an alkaline solution or other solution. In this way, the external electrode conductive layers 25*d* and 35*d* are formed in the openings h3. The via hole conductors V3 are formed in the via holes H3. In FIG. 5D, the external electrode conductive layers 25*d* and 35*d* and the via hole conductors V3 are not illustrated because they are hidden by the coil conductive layers 18*d* and the external electrode conductive layers 25*e* and 35*e*.

Figure 6A:
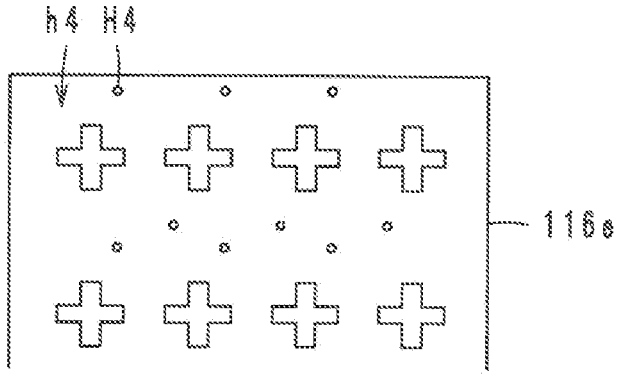
FIGS. 6A to 6D are plan views of the electronic component in production.

Then, as illustrated in FIG. 6A, an insulating paste layer 116*e* having openings h4 and via holes H4 is formed by a photolithography step. Specifically, insulating paste is applied by screen printing to form an insulating paste layer on the insulating paste layer 116*d*. In addition, the photosensitive conductive paste layer is irradiated with ultraviolet rays or other rays through a photomask and developed using an alkaline solution or other solution. The insulating paste layer 116*e* is a paste layer that is to become the insulator layer 16*e*, which is an internal insulator layer. Each of the openings h4 has substantially the same shape as that of each of the openings h2.

Figure 6B:
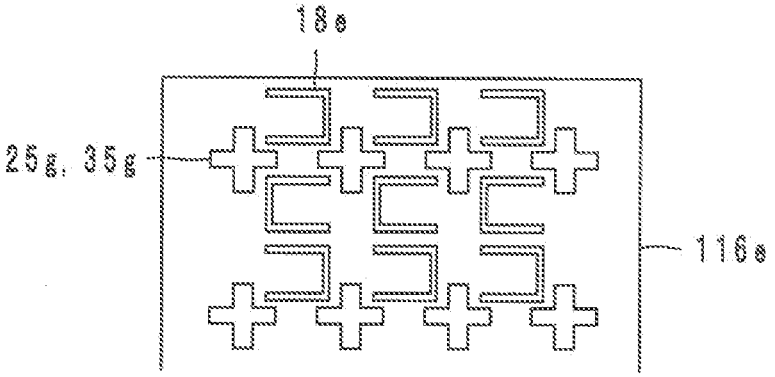

Then, as illustrated in FIG. 6B, the coil conductive layers 18*e*, the external electrode conductive layers 25*f*, 25*g*, 35*f*, and 35*g*, and the via hole conductors V4 are formed by a photolithography step. Specifically, photosensitive conductive paste whose main metal component is silver is applied by screen printing to form a photosensitive conductive paste layer on the insulating paste layer 116*e*. In addition, the photosensitive conductive paste layer is irradiated with ultraviolet rays or other rays through a photomask and developed using an alkaline solution or other solution. In this way, the external electrode conductive layers 25*f* and 35*f* are formed in the openings h4. The via hole conductors V4 are formed in the via holes H4. In FIG. 6B, the external electrode conductive layers 25*f* and 35*f* and the via hole conductors V4 are not illustrated because they are hidden by the coil conductive layers 18*e* and the external electrode conductive layers 25*g* and 35*g*.

Figure 6C:
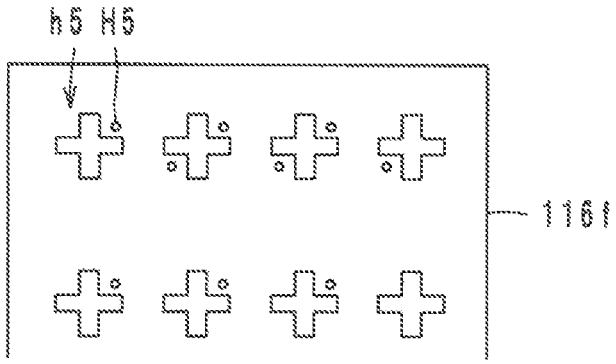

Then, as illustrated in FIG. 6C, an insulating paste layer 116*f* having openings h5 and via holes H5 is formed by a photolithography step. Specifically, insulating paste is applied by screen printing to from an insulating paste layer on the insulating paste layer 116*e*. In addition, the photosensitive conductive paste layer is irradiated with ultraviolet rays or other rays through a photomask and developed using an alkaline solution or other solution. The insulating paste layer 116*f* is a paste layer that is to become the insulator layer 16*f*, which is an inner insulator layer. Each of the openings h5 has substantially the same shape as that of each of the openings h2.

Figure 6D:
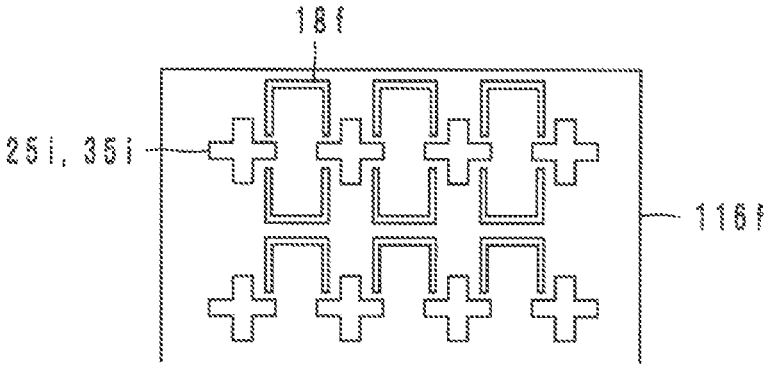

Then, as illustrated in FIG. 6D, the coil conductive layers 18*f*, the external electrode conductive layers 25*h*, 25*i*, 35*h*, and 35*i* and the via hole conductors V5 are formed by a photolithography step. Specifically, photosensitive conductive paste whose metal main component is silver is applied by screen printing to form a photosensitive conductive paste layer on the insulating paste layer 116*f*. In addition, the photosensitive conductive paste layer is irradiated with ultraviolet rays or other rays through a photomask and developed using an alkaline solution or other solution. In this way, the external electrode conductive layers 25*h* and 35*h* are formed in the openings h5. The via hole conductors V5 are formed in the via holes H5. In FIG. 6D, the external electrode conductive layers 25*h* and 35*h* and the via hole conductors V5 are not illustrated because they are hidden by the coil conductive layers 18*f* and the external electrode conductive layers 25*i* and 35*i*.

Figure 7A:
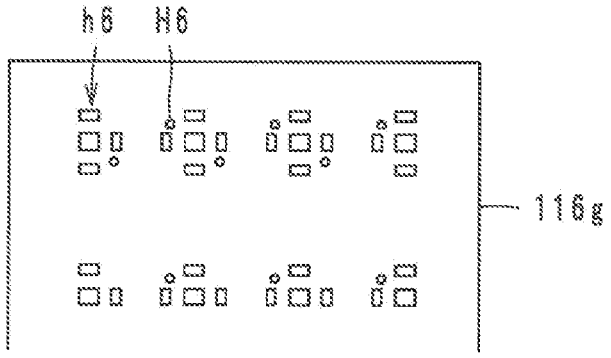
FIGS. 7A to 7C are plan views of the electronic component in production.

Then, as illustrated in FIG. 7A, an insulating paste layer 116*g* having a plurality of opening group h6 and via holes H6 is formed by a photolithography step. Specifically, insulating paste is applied by screen printing to form an insulating paste layer on the insulating paste layer 116*f*. In addition, the photosensitive conductive paste layer is irradiated with ultraviolet rays or other rays through a photomask and developed using an alkaline solution or other solution. The insulating paste layer 116*g* is a paste layer that is to become the insulator layer 16*g*, which is an internal insulator layer. Each of the opening group h6 has substantially the same shape as that of set of the external electrode conductive layers 20*d*, 21*d*, 22*d*, 30*d*, 31*d*, and 32*d* and overlaps the external electrode conductive layers 20*d*, 21*d*, 22*d*, 30*d*, 31*d*, and 32*d*.

Figure 7B:
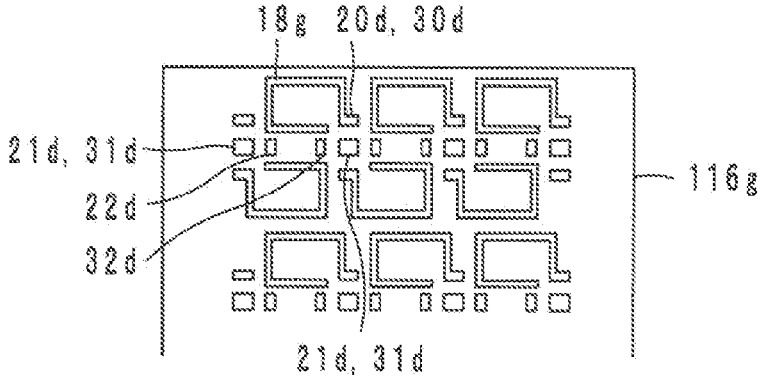

Then, as illustrated in FIG. 7B, the coil conductive layers 18*g* and the external electrode conductive layers 20*c*, 20*d*, 21*c*, 21*d*, 22*c*, 22*d*, 30*c*, 30*d*, 31*c*, 31*d*, 32*c*, and 32*d* and the via hole conductors V6 are formed by a photolithography step. Specifically, photosensitive conductive paste whose metal main component is silver is applied by screen printing to form a photosensitive conductive paste layer on the insulating paste layer 116*g*. In addition, the photosensitive conductive paste layer is irradiated with ultraviolet rays or other rays through a photomask and developed using an alkaline solution or other solution. In this way, the external electrode conductive layers 20*c*, 21*c*, 22*c*, 30*c*, 31*c*, and 32*c* are formed in the openings h6. The via hole conductors V6 are formed in the via holes H6. In FIG. 7B, the external electrode conductive layers 20*c*, 21*c*, 22*c*, 30*c*, 31*c*, and 32*c* and the via hole conductors V6 are not illustrated because they are hidden by the coil conductive layers 18*g* and the external electrode conductive layers 21*d*, 22*d*, 30*d*, and 31*d*.

Figure 7C:
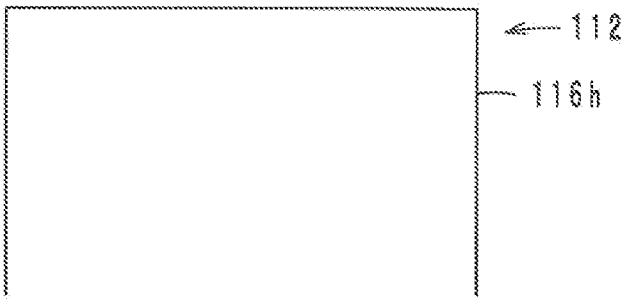

Then, as illustrated in FIG. 7C, an insulating paste layer 116*h* is formed on the insulating paste layer 116*g* by application of insulating paste by screen printing. The insulating paste layer 116*g* is a paste layer that is to become the insulator layer 16*h*, which is an outer insulator layer. Through the above-described steps, a mother laminate 112 is obtained.

Then, the mother laminate 112 is cut into a plurality of unfired laminates 12 by, for example, dicing. In the step of cutting the mother laminate 112, each of the external electrodes 14*a* and 14*b* is made to be exposed from each of the laminates 12 in two neighboring cut surfaces formed by the cutting. The two neighboring cut surfaces for the external electrode 14*a* are the lower surface S2 and the end surface S3, whereas those for the external electrode 14*b* are the lower surface S2 and the end surface S4.

Then, the unfired laminate 12 is fired under a predetermined condition, and the fired laminate 12 is obtained. In addition, the laminate 12 is subjected to barreling.

Lastly, the portions in the external electrodes 14*a* and 14*b* exposed from the laminate 12 are subjected to nickel plating with a thickness of approximately 2 μm to 7 μm and tin plating with a thickness of approximately 2 μm to 7 μm. Through the above-described steps, the electronic component 10 is completed.

In the electronic component 10 configured in the above-described way, the occurrence of breakage of the laminate 12 can be suppressed. More specifically, the process of producing the stacked inductor 500 described in Japanese Unexamined Patent Application Publication No. 2010-165975 contains a dividing step of dividing a mother laminate into individual laminates 502 and a firing step of firing the laminates 502. In the dividing step and the firing step, a stress is applied to each of the laminates 502. Because the material of the laminate 502 differs from the material of the external electrodes 508 and 510, when a stress is applied to the laminate 502, an internal stress remains between the laminate 502 and the external electrodes 508 and 510. If the laminate 502 is subjected to barrel polishing or plating in the state where the internal stress remains, the impact of the barrel polishing or plating may cause in a portion in each of the insulating layers 504*a* and 504*d*, the portion being in contact with the external electrodes 508 and 510. As the result, breakage such as a crack or the like is caused in the portion therein.

In contrast, in the electronic component 10, the side surfaces S10 to S13 located on both sides of the external electrodes 14*a* and 14*b* in the y-axis direction are uneven. Therefore, the area in which the insulator layers 16*a* and 16*h* on both sides of the external electrodes 14*a* and 14*b* in the y-axis direction are in contact with the external electrodes 14*a* and 14*b* is increased, whereby the adhesion therebetween is high. As a result, even if an impact occurs in the laminate 12, the occurrence of breakage such as a crack in the portions of the insulator layers 16*a* and 16*h* in contact with the external electrodes 14*a* and 14*b* is suppressed. That is, breakage of the electronic component 10 is suppressed.

In the electronic component 10 of the preferred embodiments, both sides of the external electrodes 14*a* and 14*b* in the y-axis direction is overlaid with the insulator layers 16*a* and 16*h*. However, it is not restrictive and it is possible to change to only one of the external electrodes being overlaid with insulator layer.

Figure 8A:
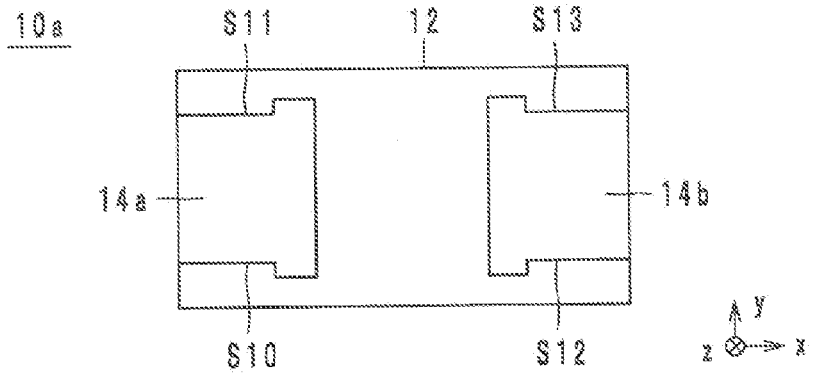
FIG. 8A illustrates an electronic component in plan view from the negative z-axis direction.
Figure 8B:
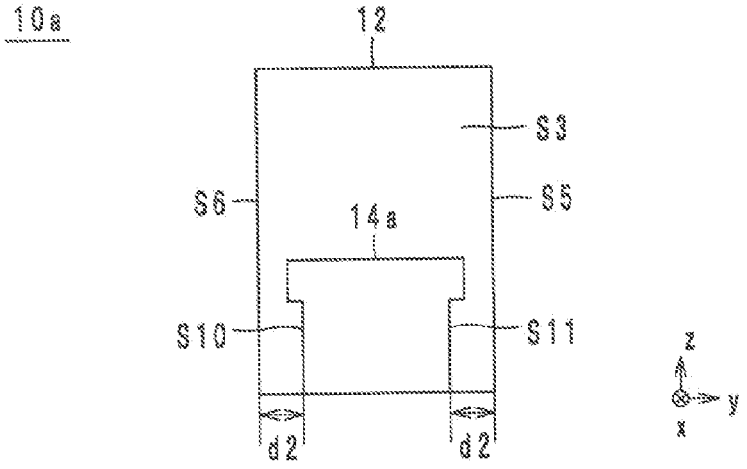
FIG. 8B illustrates the electronic component in plan view from the negative x-axis direction.
Figure 8C:
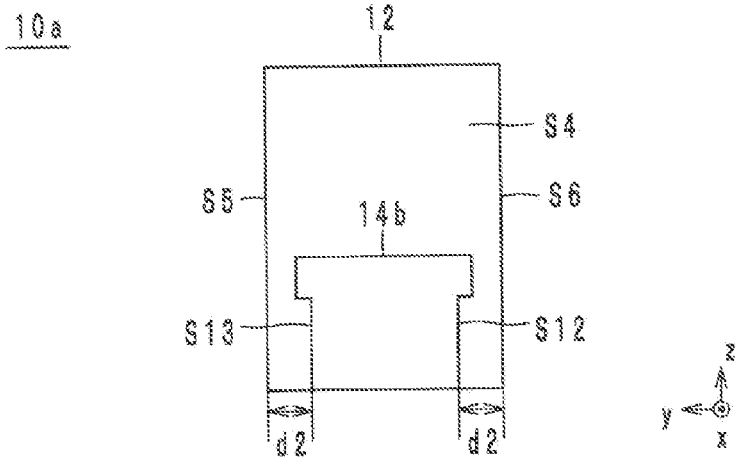
FIG. 8C illustrates the electronic component in plan view from the positive x-axis direction.
Figure 9:
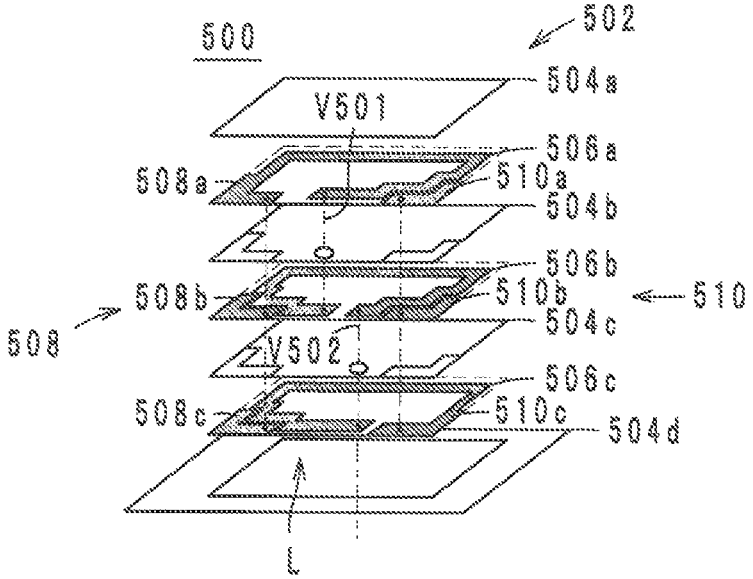
FIG. 9 Related Art
FIG. 9 is an exploded perspective view of a stacked inductor described in the related art.

Next, an electronic component 10*a* according to a variation is described with reference to the drawings. FIG. 8A illustrates the electronic component 10*a* in plan view from the negative z-axis direction, FIG. 8B illustrates the electronic component 10*a* in plan view from the negative x-axis direction, and FIG. 8C illustrates the electronic component 10*a* in plan view from the positive x-axis direction.

The electronic component 10*a* differs from the electronic component 10 in the shape of each of the external electrodes 14*a* and 14*b*. The electronic component 10*a* does not include the external electrode conductive layers 21 and 31. Thus, the side surface S10 has a shape in which in plan view from the negative z-axis direction the end in the positive x-axis direction protrudes in the negative y-axis direction farther than the other portions. The side surface S10 also has a shape in which in plan view from the negative x-axis direction the end in the positive z-axis direction protrudes in the negative y-axis direction farther than the other portions.

Similarly, the side surface S11 has a shape in which in plan view from the negative z-axis direction the end in the positive x-axis direction protrudes in the positive y-axis direction farther than the other portions. The side surface S11 also has a shape in which in plan view from the negative x-axis direction the end in the positive z-axis direction protrudes in the positive y-axis direction farther than the other portions.

The side surface S12 has a shape in which in plan view from the negative z-axis direction, the end in the negative x-axis direction protrudes in the negative y-axis direction farther than the other portions. The side surface S12 also has a shape in which in plan view from the positive x-axis direction, the end in the positive z-axis direction protrudes in the negative y-axis direction farther than the other portions.

Similarly, the side surface S13 has a shape in which in plan view from the negative z-axis direction the end in the negative x-axis direction protrudes in the positive y-axis direction farther than the other portions. The side surface S13 also has a shape in which in plan view from the positive x-axis direction the end in the positive z-axis direction protrudes in the positive y-axis direction farther than the other portions.

In the above-described electronic component 10*a*, breakage of the laminate can be suppressed. More specifically, a corner of the laminate is easily broken by an impact from the outside. In the electronic component 10*a*, the width of the external electrode 14*a* in the y-axis direction is not a maximum in the corner between the lower surface S2 and the end surface S3, and the width of the external electrode 14*b* in the y-axis direction is not a maximum in the corner between the lower surface S2 and the end surface S4. Therefore, the distance d2 from each of the external electrodes 14*a* and 14*b* to each of the side surfaces S5 and S6 in the corner of the electronic component 10*a* is larger than the distance d1 from each of the external electrodes 14*a* and 14*b* to each of the side surfaces S5 and S6 in the corner of the electronic component 10. Accordingly, in the electronic component 10*a*, the occurrence of breakage in a corner of the laminate 12 can be suppressed.

To form the above-described external electrodes 14*a* and 14*b*, in the steps illustrated in FIGS. 4C and 7A, the insulating paste layers 116*b* and 116*g* are formed such that the openings h1 and h6 are not located in the corner between the two neighboring cut surfaces formed by cutting of the mother laminate 112. In addition, in the steps illustrated in FIGS. 4B and 7B, the external electrode conductive layers 21 and 31 are not formed.

In the electronic components 10 and 10*a*, all of the side surfaces S10 and S11 of the external electrode 14*a* and the side surfaces S12 and S13 of the external electrode 14*b* are uneven. However, suppression of lamination breakage can be achieved with at least one of the side surfaces S10 and S11 uneven and/or at least one of the side surfaces S12 and S13 uneven.

In the electronic components 10 and 10*a*, both sides of the external electrodes 14*a* and 14*b* in the y-axis direction is overlaid with the insulator layers 16*a* and 16*h*. However, these examples are not restrictive and it is possible to change them to only one of the external electrodes being overlaid with insulator layer.

As described above, preferred embodiments of the present invention are useful in an electronic component and a method of producing the same and, in particular, advantageous in that breakage of a laminate can be suppressed.

While exemplary embodiments have been described above, it is to be understood that variations and modifications will be apparent to those skilled in the art without departing from the scope and spirit of the disclosure.

What is claimed is:

1. An electronic component comprising:

a laminate in which plural insulator layers are stacked; and an external electrode exposed to an exterior of the laminate and comprising plural conductive layers stacked in a stacking direction, each of said conductive layers passing through a first part of the plural insulator layers in the stacking direction, wherein sides of the external electrode respectively facing in the stacking direction and facing in a direction 180° opposite the stacking direction are overlaid with a second parts of the plural insulator layers such that the entire external electrode is covered by the second parts of the plural insulator layers in the stacking direction and in the direction 180° opposite the stacking direction, and wherein at least one side surface of the external electrode either facing the stacking direction or facing the direction 180° opposite the stacking direction includes a portion that is uneven with another portion of the side surface.

2. The electronic component according to claim 1, wherein the laminate includes a mounting surface, the mounting surface being a series of outer edges of the plurality of insulator layers, and the external electrode is exposed to the exterior of the laminate in the mounting surface.

3. The electronic component according to claim 2, wherein the external electrode is exposed to the exterior of the laminate so as to extend over a border between the mounting surface and an end surface, the end surface being adjacent to the mounting surface and being a series of outer edges of the plurality of insulator layers.

4. The electronic component according to claim 3, wherein the external electrode has a width in the stacking direction, the width not being a maximum in a corner between the mounting surface and the end surface.

5. The electronic component according to claim 1, wherein the uneven side surface is located at at least one end thereof in the stacking direction, the uneven side surface being formed of the stacked conductive layers having different shapes in plan view from the stacking direction.

* * * * *